US005108787A

United States Patent [19]

Hiraki et al.

[11] Patent Number: 5,108,787

[45] Date of Patent: Apr. 28, 1992

[54] METHOD FOR APPLYING MAGNETIC LIQUID TO MOVING WEB

[75] Inventors: Yasuhito Hiraki; Shinsuke Takahashi; Naoyoshi Chino, all of Kanagawa, Japan

[73] Assignee: Fuji Photo Film Co., Ltd., Kanagawa, Japan

[21] Appl. No.: 636,465

[22] Filed: Dec. 31, 1990

[30] Foreign Application Priority Data

Jan. 8, 1990 [JP] Japan ..... 2-601
Mar. 14, 1990 [JP] Japan ..... 2-61190

[51] Int. Cl.[5] ..... H01F 10/02

[52] U.S. Cl. ..... 427/128; 428/694; 428/900

[58] Field of Search ..... 427/128-132, 427/48; 428/900, 694

*Primary Examiner*—Bernard Pianalto

*Attorney, Agent, or Firm*—Sughrue, Mion, Zinn, Macpeak & Seas

[57] ABSTRACT

A method for manufacturing a magnetic recording medium or the like and an applicator device for applying a coating to manufacture a magnetic recording medium resulting in the production of a recording medium having a uniform coating of magnetic liquid without streaking. In one embodiment, the flow index A expressed by an equation (1) below and in which L, V and $\gamma$ denote the length of the liquid on the surface of the doctor edge portion in the direction of movement of the carrier along the surface of the doctor edge portion, the mean speed of the flow of the liquid on the surface of the doctor edge portion, and the shearing speed of the liquid on the surface of the doctor edge portion, respectively, is 100 or more:

$$A = \dot{\gamma}\frac{L}{V}. \quad (1)$$

2 Claims, 4 Drawing Sheets

METHOD FOR APPLYING MAGNETIC LIQUID TO MOVING WEB

BACKGROUND OF THE INVENTION

The present invention relates to a method for applying a magnetic liquid including at least a magnetic substance and a binder to a flexible carrier (which is hereinafter often referred to as web) such as a plastic film, paper or a metal leaf.

Conventional application methods in which a liquid is applied to a web are generally practiced with an application device of the extrusion type, an application device of the curtain flow type, an application device of the doctor blade type, an application device of the slide coating type, etc. The application method practiced with the application device of the extrusion type is capable of applying a liquid to the web to form a uniform thin film thereon, and is used in various fields, as described in the Japan Patent Applications (OPI) Nos. 84771/82, 104666/83 and 238179/85 (the term "OPI" as used herein means an "unexamined published application"). However, the conditions for good application in the method which is practiced with the application device of the extrusion type are limited within narrow ranges.

In recent years, the density of recording in a magnetic recording medium and the number of the layers thereof have been increased. For that reason, it has been required that the thickness of a magnetic layer on a nonmagnetic carrier be decreased in manufacturing the medium. The speed of application of a liquid to the carrier has been desired to be higher to enhance the productivity for the medium. Magnetic substances have been improved so that a magnetic oxide powder of high $S_{BET}$ value and using barium ferrite have come into use. As a result, the viscosity of the applied liquid has increased. This has resulted in a problem in that it is difficult to obtain conditions for good application of the liquid, and the surface of the film of the liquid applied on the web is deteriorated due to the high cohering property of the liquid, making it impossible to render the quality of the film stable and good.

To solve this problem, an application device, the flow property of an applied liquid in the slot of which is controlled to improve the properties of the magnetic recording medium, particularly the electromagnetic conversion property thereof, has been proposed, as disclosed in the Japan Patent Application (OPI) No. 189369/89. The flow property of the applied liquid is set in accordance with a flow index based on the mean speed of the flow of the liquid in the slot and the mean viscosity thereof in the slot, to thereby establish the design factors of the application device.

However, with the use of the application device disclosed in Japanese Patent Application (OPI) No. 189369/89, a good film cannot necessarily be formed from the applied liquid. Particularly, the higher the $S_{BET}$ value of the magnetic substance of the liquid is set (45 $m^2/g$ or more) to increase the viscosity thereof, the harder it is to obtain a desired electromagnetic conversion property. This is a significant problem.

The present inventors conducted intensive studies on application factors which determine the properties of the film of the applied liquid, particularly, the electromagnetic conversion property thereof. As a result, they found that important, what is decisively important is the flow property of the liquid on the surface of a doctor edge portion. In other words, even if the flow property of the applied liquid in the slot is predetermined, the flow property changes on the surface of the doctor edge portion due to the re-cohering property of the liquid or the like, as a result of which minute streaks occur in the surface of the magnetic layer of the magnetic recording medium. The occurrence of such streaking degrades the electromagnetic conversion property of the layer. Therefore, the flow property of the applied liquid on the surface of the doctor edge portion is decisively important.

The present invention further relates to an applicator device, and more particularly to a device for coating a magnetic liquid, which includes at least a magnetic substance and a binder, onto a flexible carrier, or web, made of a plastic film, paper, metal leaf, or the like.

Conventional methods for coating a liquid onto a web generally are practiced with applicators of the extrusion type, curtain flow type, doctor blade type, slide coating type, and so forth. The method which is practiced with the extrusion-type applicator is capable of applying the liquid to the web so as to provide a uniform thin layer of the liquid thereon. Accordingly, such an applicator has been used in various fields, as described in Japanese Patent Applications (OPI) Nos. 104666/83 and 238179/85, Japanese Patent Application No. 84711/89, among others.

Since the doctor edge portion of an application device disclosed in Japanese Patent OPI No. 104666/83 has two flat surfaces meeting each other and defining an obtuse angle therebetween, the doctor edge portion can be processed with high accuracy, and applied liquid can be pressed appropriately on a web. Also, the device copes well with fluctuations in the tension of the web and the like, air is prevented effectively from being entrained into the liquid at the time of rapid application thereof, and the nonuniformity of thickness of the film of the applied liquid on the web is suppressed. However, if the applicator operates at a relatively high speed, such as from about 200 m/min to about 300 m/min, a problem can arise in that foreign matter in the liquid is likely to be trapped at the top of the doctor edge portion, causing streaking in the film of the applied liquid on the web.

To solve this problem, an application device in which the positional relationship between the surface of a doctor edge portion and that of a back edge portion is set in a prescribed range and the curvature of the surface of the doctor edge portion is also set in a prescribed range has been proposed, as disclosed in the Japanese Patent OPI No. 238179/85. The surface of the doctor edge portion is curved so that the area of pressing of a web by the surface of the portion can be widened somewhat to prevent a streak from being caused due to a narrow area of pressing of the web. While this technique solves the aforementioned problem, an additional problem arises, for the following reason. It has been required recently that the speed of application of a liquid to a web be as high as 300 m/min or more, and that the thickness of the film of the applied liquid on the web be as small as 10 $cc/m^2$ or less. As a result, entrainment of air into the film has been noticed again.

Under such circumstances, an application device has been proposed, as disclosed in Japanese Patent Application No. 84711/89. In that device, the radius of the curvature of the surface of a doctor edge portion is set in a prescribed range of small values such as 2 mm or less, so that the pressure of the surface on a liquid and a web is increased to prevent air from being involved into the film of the applied liquid on the web. However, a new problem arises in that, since the radius of the curvature of the surface of the doctor edge portion is made small, the length of the surface along the direction of the movement of the web also must be small. This means that, if the length of the surface of the doctor edge portion along the direction of the movement of the web is to be increased as the radius of the curvature of the surface is 5 mm or less, for example, then the angle between the inner surface of the portions of the web, which are bent from each other around the top of the doctor edge portion, needs to be decreased in order to augment the length. In that case, the load on the web needs to be made heavier than originally necessary due to the decrease in the angle, and the angle between the vertical surface of a back edge portion and the top thereof needs to be acute. As a result, it is likely that the web will be scraped or stretched at best causing difficulty or lowering the quality of application and of the resulting product, and at worst causing the web to break.

Although the thickness of the film of the applied liquid on the web can be made uniform with these extrusion-type applicators, only a narrow range of conditions for good application is possible, as described above. Particularly in recent years, when the density of recording in a magnetic recording medium and the number of the layers thereof have increased so that the thickness of the magnetic layer on a nonmagnetic web needs to be decreased during manufacture of the medium, it is desirable, more so now than previously, that the speed of the application of a liquid to the web be heightened to enhance productivity of the medium.

Further, since magnetic substances have been improved to use a magnetic oxide powder of high $S_{BET}$ value and a barium ferrite to increase the density of recording in a magnetic recording medium, the viscosity of an applied liquid including such a substance is increased, causing a problem in that the state of the surface of the film of the applied liquid on a web cannot be improved with an applicator in which the length of the surface of the doctor edge portion along the direction of the movement of the web cannot be made sufficiently large. In other words, the problem is that it has been found through a microscope that the state of the surface has deteriorated due to the high cohering property of the liquid, making it impossible to render the film of the applied liquid on the web desirably stable.

In particular, a problem arises in that, the higher the $S_{BET}$ value of a magnetic substance included in an applied liquid (45 $m^2/g$ or more) so as to raise the viscosity of the liquid, the harder it is to achieve a desired electromagnetic converting property.

SUMMARY OF THE INVENTION

The present invention was made in order to solve the above problems. Accordingly, it is an object of the present invention to provide a method of manufacturing a magnetic recording medium in which a liquid is applied under prescribed conditions so that the electromagnetic conversion property of the medium is acceptable, particularly when the $S_{BET}$ value of the magnetic substance of the liquid and the viscosity thereof are high.

In the application method provided in accordance with the present invention for manufacturing a magnetic recording medium, a liquid containing a magnetic substance whose $S_{BET}$ value (the surface area of the substance per unit mass) is 45 $m^2/g$ or more is included, and the added quantity of a main binder per unit weight for the $S_{BET}$ value of the magnetic substance is 2.3 $mg/m^2$ or more is continuously extruded from the outlet portion of a slot to the surface of a flexible carrier continuously moving along the surface of a back edge portion and that of a doctor edge portion so that the liquid is applied to the surface of the carrier. The method is characterized in that application is performed so that a flow index A, which is expressed by equation (1) below and in which L, V and $\dot{\gamma}$ denote the length of the liquid on the surface of the doctor edge portion in the direction of movement of the carrier along the surface of the doctor edge portion, the mean speed of the flow of the liquid on the surface of the doctor edge portion, and the shearing speed of the liquid on the surface of the doctor edge portion, respectively, is 100 or more.

$$A = \dot{\gamma}\frac{L}{V} \tag{1}$$

The length L, the mean speed V and the shearing speed $\gamma$ are determined by factors such as the form of the extruder used for applying the liquid to the carrier, the speed of application of the liquid, the supply pressure of the liquid, the thickness of the film of the applied liquid on the carrier, and the physical properties of the liquid.

In view of the foregoing, it is a further object of the invention to provide an applicator device for coating a magnetic recording medium which is capable of applying a liquid very rapidly to make a thin layer so that, even if the magnetic substance of the liquid is. high in $S_{BET}$ value, making the viscosity of the liquid high, the surface of the layer and the electromagnetic converting property of the medium are sufficiently desirable.

In the applicator device provided in accordance with the present invention, the liquid is extruded continuously from the outlet portion of a slot to the surface of a flexible carrier moving continuously along the surface of a back edge portion and that of a doctor edge portion, so that the liquid is applied to the surface of the carrier. In the inventive device, the doctor edge portion includes a curved surface extending to the downstream edge of the outlet portion of the slot, and a flat surface extending downstream from the curved surface at the downstream edge thereof. An edge B of the surface of the back edge portion at the upstream edge of the slot is located so that the angle $\theta_1$ between the tangent on the curved surface of the doctor edge portion at a meeting edge E of both the curved surface and the flat surface and the tangent on the surface of the back edge portion at the edge B, and the angle $\theta_2$ between the tangent on the surface of the back edge portion at the edge B and the tangent on the curved surface of the doctor edge portion and on the edge B satisfy the condition $\theta_1 < \theta_2 < 180°$ with respect to the cross sections of the back edge portion and the doctor edge portion. The radius of curvature of the curved surface satisfies the relation $R \leqq 8.0$ mm. The angle $\angle COE$ between the radius of the curvature of the curved surface at the meeting edge E and the radius of the curvature of the curved surface at the downstream edge C of the outlet portion of the slot satisfies the relation $\angle COE \leqq 30°$. Finally, the total length of the surfaces of the doctor edge portion along the direction of the movement of the carrier is at least 2 mm.

DESCRIPTION OF THE PREFERRED EMBODIMENTS

Preferred embodiments of the present invention are hereafter described in detail with reference to the drawings attached hereto.

Figure 1:
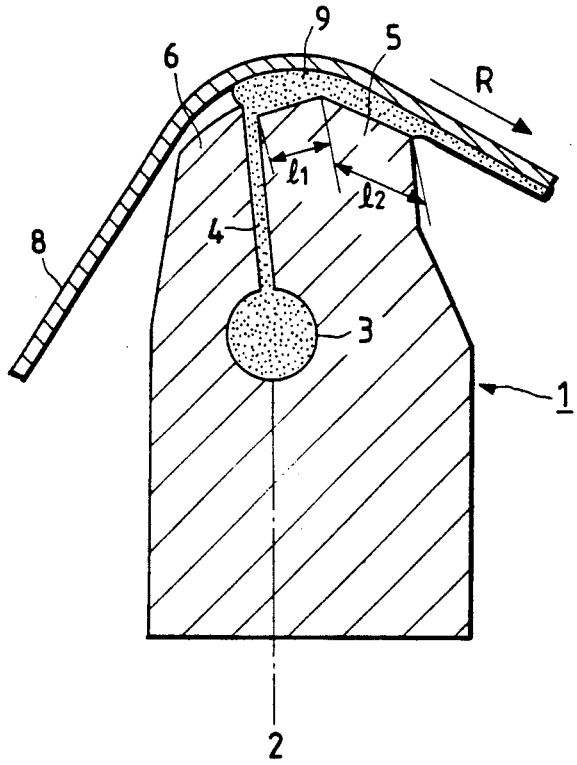
FIG. 1 is a partial sectional view of an extrusion-type application device for practicing an application method which is an embodiment of the present invention.
Figure 2:
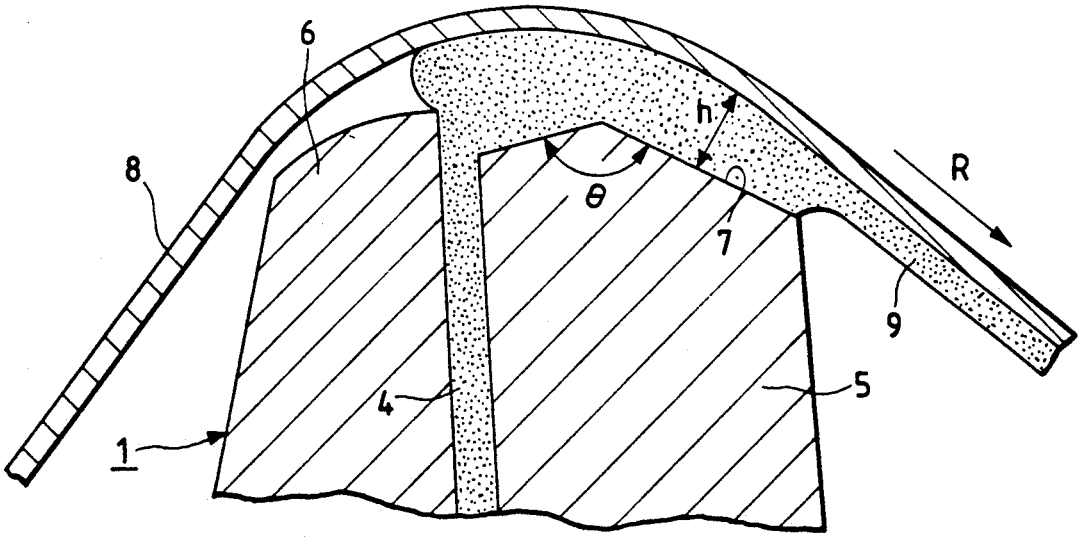
FIG. 2 is an enlarged partial sectional view of the doctor edge portion of the device.

FIGS. 1 and 2 show the extruder 1 used in the practice of an extrusion-type application method. The extruder 1 includes a reservoir 3, a slot 4, a doctor edge portion 5, and a back edge portion 6, as shown in FIG. 1. In the method, a magnetic liquid 9, in which a magnetic substance whose $S_{BET}$ value is 45 $m^2/g$ or more is included, and the added quantity of a main binder per unit weight for the $S_{BET}$ value o the magnetic substance is 2.3 $mg/m^2$ or more, is applied at a uniform thickness to a web 8 moving at a fixed speed u. The device includes a liquid supply line 2 having a fixed quantity liquid supply pump (not shown in the drawings) provided outside the extruder 1 and capable of continuously supplying the magnetic liquid 9 at a fixed flow rate, and a pipe extending in the body of the extruder along the width of the web 8 so that the pump communicates with the reservoir 3. The slot 4 is a relatively narrow passage extending in the body of the extruder 1 from the reservoir 3 toward the web 8 and along the width of the web, similarly to the reservoir, and opening with a predetermined width in the surface of the extruder. The length of the outlet opening of the slot 4, which is located in the surface of the extruder 1 and extends along the width of the web 8, is nearly equal to the width of the liquid application area of the web. The doctor edge portion 5 is located at the trailing side of the outlet opening of the slot 4 with regard to the direction of movement of the web 8. The surface 7 of the doctor edge portion 5 which faces the web 8 is composed of parts which extend angularly to each other and between which the doctor edge portion forms a vertex angle, which is an obtuse angle of 135 degrees or more. The length ; of the upstream part of the surface 7 of the doctor edge portion 5 and that $l_2$ of the downstream part thereof are set in ranges of 0.5 mm to 15 mm and 0.1 mm to 2 mm, respectively. The back edge portion 6 is located at the leading side of the outlet opening of the slot with regard to the direction of movement of the web 8.

The thickness h of the liquid 9 applied to the web 8 by using the extruder 1 is equal to the distance between the surface 7 of the doctor edge portion 5 and that of the web. The length L of the liquid 9 on the surface 7 of the doctor edge portion 5 in the direction of the movement of the web 8, the mean speed V of the flow of the liquid on the surface and the shearing speed $\dot{\gamma}$ of the liquid on the surface can be approximately determined as follows:

$$L = l_1 \pm l_2 \quad (2)$$

$$V = R/2 \quad (3)$$

$$\dot{\gamma} = R/2h \quad (4)$$

The mean flow speed v and the shearing speed $\dot{\gamma}$ may be otherwise appropriately estimated or measured. The flow index expressed by the equation (1) is determined in terms of the approximately determined values of the length L, mean flow speed V and shearing speed $\dot{\gamma}$ of the liquid on the surface of the doctor edge portion. The magnetic liquid 9 is applied to the surface of the web 8 under such conditions that the flow index A is 100 or more. It is particularly preferable that the conditions are set to make the shearing speed $\dot{\gamma}$ equal to or more than $2 \times 10^4 \text{ sec}^{-1}$. In general, the flow index determines the flow property of an applied liquid on the surface of a doctor edge portion. In particular, the flow index A accurately expresses the flow property of the magnetic liquid 9 whose $S_{BET}$ value and viscosity are so high that the flow property is likely to change on the surface of the doctor edge portion 5 due to the re-cohering property of the liquid or the like. For that reason, the application conditions which determine the electromagnetic covering property of the film of the applied magnetic liquid 9, in particular, can be optimized in terms of the flow index A.

The application method is not confined to the use of an extruder 1 whose form is shown in the drawings, but may be applied to the use of an extruder differing therefrom in the forms of the surfaces of the doctor edge portion and back edge portion.

The flexible carrier 8 may be a high-molecular film such as a polyethylene terephthalate film, paper, a metal sheet or the like.

In an application method provided in accordance with the present invention used in the manufacture of a magnetic recording medium, a liquid in which a magnetic substance whose $S_{BET}$ value is 45 $m^2/g$ or more is included, and the added quantity of a main binder per unit weight for the $S_{BET}$ value of the substance is 2.3 $mg/m^2$ or more is continuously extruded from the outlet portion of a slot onto the surface of flexible carrier continuously moving along the surface of a back edge portion and that of a doctor edge portion to apply the liquid to the surface of the carrier. The application is performed so that the flow index A, which is expressed by equation (1) below and in which L, V and $\dot{\gamma}$ denote the length of the liquid on the surface of the doctor edge portion in the direction of the movement of the carrier along the surface of the doctor edge portion, the mean speed of the flow of the liquid on the surface of the doctor edge portion and the shearing speed of the liquid on the surface of the doctor edge portion, respectively, is 100 or more.

$$A = \dot{\gamma} \frac{L}{V} \quad (1)$$

In general, the flow index A determines the flow property of an applied liquid on the surface of a doctor edge portion. In particular, the flow index a accurately expresses the flow property of the applied magnetic liquid whose $S_{BET}$ value and viscosity are so high that the flow property is likely to change on the surface of the doctor edge portion due to the re-cohering property of the liquid or the like. For that reason, the electromagnetic conversion property of the magnetic recording medium manufactured by applying the liquid whose $S_{BET}$ value and viscosity are high is made good enough.

The novel effects of the present invention are clarified by the following description of actual examples of the of the invention.

Applied liquid

The substances shown in Table 1 where put in a ball mill and well mixed and dispersed for ten and half hours so that magnetic liquids A, A2, A3, A4, B1, B2, B3, B4, C1, C2. C3, D1, D2, D3 and D4 were produced. The values of the magnetic alloys A B C and D for the liquids 45 $m^2/g$, 50 $m^2/g$, 55 $m^2/g$, and 60 $m^2/g$, respectively. The quantities X and Y of a copolymer of vinyl chloride and vinyl acetate and urethane, which were the main binders for the liquids, are shown in Table 2. Four kinds of liquids were thus produced from each of the magnetic alloys.

TABLE 1

| | |
|---|---|
| Magnetic alloy (magnetic metal powder of iron) | 100 parts by weight |
| Copolymer of vinyl chloride and vinyl acetate (containing sodium sulfonate and epoxy group) | X parts by weight |
| urethane (polyurethane containing sulfonic group) | Y parts by weight |
| Hardener | 5 parts by weight |
| Stearic acid | 0.5 parts by weight |
| Oleic acid | 0.5 parts by weight |
| Carbon black (80 mμ in mean grain diameter) | 1 part by weight |
| Butyl stearate | 1 part by weight |
| Abrasive ($\alpha$-$Al_2O_3$) | 10 parts by weight |
| Methyl ethyl ketone | 180 parts by weight |
| Cyclohexane | 120 parts by weight |

TABLE 2

| Magnetic liquid | Magnetic alloy | Copolymer (X parts by weight) | Urethane (Y parts by weight) | X + Y | Quantity of main binders per unit weight for $S_{BET}$ value ($mg/m^2$) |
|---|---|---|---|---|---|
| A1 | A | 6.00 | 3.00 | 9.00 | 2.0 |
| A2 | | 6.90 | 3.45 | 10.35 | 2.3 |
| A3 | | 7.50 | 3.75 | 11.25 | 2.5 |
| A4 | | 6.00 | 5.25 | 11.25 | 2.5 |
| B1 | B | 6.7 | 3.3 | 10.0 | 2.0 |
| B2 | | 7.7 | 3.8 | 11.5 | 2.3 |
| B3 | | 8.3 | 4.2 | 12.5 | 2.5 |
| B4 | | 9.3 | 4.7 | 14.0 | 2.8 |
| C1 | C | 7.3 | 3.7 | 11.0 | 2.0 |
| C2 | | 8.45 | 4.2 | 12.65 | 2.3 |
| C3 | | 9.15 | 4.6 | 13.75 | 2.5 |
| C4 | | 10.3 | 5.1 | 15.4 | 2.8 |
| D1 | D | 8.0 | 4.0 | 12.0 | 2.0 |
| D2 | | 9.2 | 4.6 | 13.8 | 2.3 |
| D3 | | 10.0 | 5.0 | 15.0 | 2.5 |
| D4 | | 11.2 | 5.6 | 16.8 | 2.8 |

Actual Example 1 of the Invention

The magnetic liquids A1, A2, A3, A4, B12, B2, B3, B4, C1, C2, C3, C4, D1, D2, D3 and D4 were applied to polyethylene terephthalate carriers of 20 μ in thickness and 300 mm in width by an extrusion-type application device partly shown in FIGS. 1 and 2. The conditions for the application were that the length L o the magnetic liquid on the surface of the doctor edge portion of the extruder, the width of the slot, the speed of application, the tension o the carrier at the extruder, and the thickness of the film of the applied liquid on the carrier were 1 mm, 0.6 mm, 100 m/min, 4 kg for 300 mm in width, and 10 μ, respectively. The surfaces of the magnetic layers formed of the applied liquids on the carriers were observed, and the electromagnetic conversion properties of the layers were examined. Table 3 shows the results of the observation and examination.

TABLE 3

| Applied liquid | Application speed (m/min) | Thickness of film (μ) | Evaluation |
|---|---|---|---|
| A1 | 100 | 10 | × |
| A2 | 100 | 10 | Δ |
| A3 | 100 | 10 | ○ |
| A4 | 100 | 10 | ○ |
| B1 | 100 | 10 | × |
| B2 | 100 | 10 | Δ |
| B3 | 100 | 10 | ○ |
| B4 | 100 | 10 | ◎ |
| C1 | 100 | 10 | × |
| C2 | 100 | 10 | Δ |
| C3 | 100 | 10 | ○ |
| C4 | 100 | 10 | ◎ |
| D1 | 100 | 10 | × |
| D2 | 100 | 10 | Δ |
| D3 | 100 | 10 | ○ |
| D4 | 100 | 10 | ◎ |

(Notes)
×: Minute streaks occurred, and surface was found rough by naked eye.
Δ: Small number of minute streaks occurred. but electromagnetic conversion property was acceptable.
○: Minute streaks did not occur. and electromagnetic conversion property was acceptable.
◎ : Minute streaks did not occur, but electromagnetic conversion property was good.

It is understood from Table 3 that minute streaks occurred and the electromagnetic conversion property was not good as to the high-viscosity liquids in which the $S_{BET}$ value of the magnetic alloy was 45 $m^2/g$ or more and the quantity of the main binders per unit weight for the $S_{BET}$ value of the alloy was less than 2.3 $mg/m^2$. Therefore, it is preferable that, with respect to a magnetic liquid whose magnetic alloy is 45 $m^2/g$ or more in $S_{BET}$ value of the alloy, for the quantity of the main binder to be at least 2.3 $mg/m^2$ so as to permit the formation of a magnetic layer having no minute streaks and having a good electromagnetic conversion property.

The magnetic liquid A2, which was 45 $m^2/g$ in $S_{BET}$ value, was applied to polyethylene terephthalate carriers of 20 μ in thickness and 300 mm in width by an extrusion-type application device partly as shown in FIGS. 1 and 2. The conditions for the application were that the length L of the liquid on the surface of the doctor edge portion of the extruder was 1 mm, 2 mm, 4 mm and 10 mm, the width of the slot was 0.6 mm and 0.3 mm, the speed of the application was 50 m/min, 100 m/min and 200 m/min, the tension of the carrier at the extruder was 4 kg for 300 mm in width, and the thickness of the film of the applied liquid was 10 μ, 30 μ and 50 μ.

The surfaces of the magnetic layers made of the applied liquid on the carriers were observed, and the electromagnetic conversion properties of the layers were examined. Table 4 shows the results of the observation and examination along with the shearing speed of the liquid in the slot and the viscosity thereof on the doctor edge portion.

TABLE 4

| No. | Slot width (mm) | Application speed u (m/min) | Film thickness h (μ) | Liquid length L (mm) | Shearing speed $\dot{\gamma}$ ($sec^{-1}$) | Flow index A | Shearing speed in slot ($sec^{-1}$) | (Applied liquid A3) Viscosity (cp) | Surface state |
|---|---|---|---|---|---|---|---|---|---|
| 1 | 0.6 | 50 | 10 | 1 | $4.17 \times 10^{-4}$ | 100 | 70 | 16 | ○ |
| 2 | | 50 | 10 | 2 | $4.17 \times 10^{-4}$ | 200 | 70 | 16 | ◎ |
| 3 | | 50 | 20 | 4 | $4.17 \times 10^{-4}$ | 400 | 70 | 16 | ◎ |
| 4 | | 50 | 10 | 10 | $4.17 \times 10^{-4}$ | 1000 | 70 | 16 | ◎ |
| 5 | 0.6 | 50 | 30 | 1 | $1.39 \times 10^{-4}$ | 33 | 210 | 22 | × |
| 6 | | 50 | 30 | 2 | $1.39 \times 10^{-4}$ | 67 | 210 | 22 | × |
| 7 | | 50 | 30 | 4 | $1.39 \times 10^{-4}$ | 133 | 210 | 22 | ○ |
| 8 | | 50 | 30 | 10 | $1.39 \times 10^{-4}$ | 333 | 210 | 22 | ○ |
| 9 | 0.6 | 50 | 50 | 1 | $8.33 \times 10^{-3}$ | 20 | 350 | 28 | × |
| 10 | | 50 | 50 | 2 | $8.33 \times 10^{-3}$ | 40 | 350 | 28 | × |
| 11 | | 50 | 50 | 4 | $8.33 \times 10^{-3}$ | 80 | 350 | 28 | × |
| 12 | | 50 | 50 | 10 | $8.33 \times 10^{-3}$ | 200 | 350 | 28 | ○ |
| 13 | 0.6 | 100 | 10 | 1 | $8.33 \times 10^{-4}$ | 100 | 140 | 12 | ○ |
| 14 | | 100 | 10 | 2 | $8.33 \times 10^{-4}$ | 200 | 140 | 12 | ◎ |
| 15 | | 100 | 10 | 4 | $8.33 \times 10^{-4}$ | 400 | 140 | 12 | ○ |
| 16 | | 100 | 10 | 10 | $8.33 \times 10^{-4}$ | 1000 | 140 | 12 | ◎ |
| 17 | 0.6 | 100 | 30 | 1 | $2.78 \times 10^{-4}$ | 33 | 420 | 18 | × |
| 18 | | 100 | 30 | 2 | $2.78 \times 10^{-4}$ | 67 | 420 | 18 | × |
| 19 | | 100 | 30 | 4 | $2.78 \times 10^{-4}$ | 133 | 420 | 18 | ◎ |
| 20 | | 100 | 30 | 10 | $2.78 \times 10^{-4}$ | 333 | 420 | 18 | ◎ |
| 21 | 0.6 | 100 | 50 | 1 | $1.67 \times 10^{-4}$ | 20 | 700 | 21 | × |
| 22 | | 100 | 50 | 2 | $1.67 \times 10^{-4}$ | 40 | 700 | 21 | × |
| 23 | | 100 | 50 | 4 | $1.67 \times 10^{-4}$ | 80 | 700 | 21 | × |
| 24 | | 100 | 50 | 10 | $1.67 \times 10^{-4}$ | 200 | 700 | 21 | ○ |
| 25 | 0.6 | 200 | 10 | 1 | $1.67 \times 10^{-5}$ | 100 | 280 | 10 | ◎ |
| 26 | | 200 | 10 | 2 | $1.67 \times 10^{-5}$ | 200 | 280 | 10 | ◎ |
| 27 | | 200 | 10 | 4 | $1.67 \times 10^{-5}$ | 400 | 280 | 10 | ◎ |
| 28 | | 200 | 10 | 10 | $1.67 \times 10^{-5}$ | 1000 | 280 | 10 | ◎ |
| 29 | 0.6 | 200 | 30 | 1 | $5.56 \times 10^{-4}$ | 33 | 840 | 14 | × |
| 30 | | 200 | 30 | 2 | $5.56 \times 10^{-4}$ | 67 | 840 | 14 | Δ |
| 31 | | 200 | 30 | 4 | $5.56 \times 10^{-4}$ | 133 | 840 | 14 | ◎ |
| 32 | | 200 | 30 | 10 | $5.56 \times 10^{-4}$ | 333 | 840 | 14 | ◎ |
| 33 | 0.6 | 200 | 50 | 1 | $3.33 \times 10^{-4}$ | 20 | 1400 | 17 | × |
| 34 | | 200 | 50 | 2 | $3.33 \times 10^{-4}$ | 40 | 1400 | 17 | × |
| 35 | | 200 | 50 | 4 | $3.33 \times 10^{-4}$ | 80 | 1400 | 17 | Δ |
| 36 | | 200 | 50 | 10 | $3.33 \times 10^{-4}$ | 200 | 1400 | 17 | ◎ |
| 37 | 0.5 | 100 | 10 | 1 | $8.33 \times 10^{-4}$ | 100 | 554 | 12 | ◎ |
| 38 | | 100 | 10 | 2 | $8.33 \times 10^{-4}$ | 200 | 554 | 12 | ◎ |
| 39 | | 100 | 10 | 4 | $8.33 \times 10^{-4}$ | 400 | 554 | 12 | ◎ |
| 40 | | 100 | 10 | 10 | $8.33 \times 10^{-4}$ | 1000 | 554 | 12 | ◎ |
| 41 | 0.3 | 100 | 30 | 1 | $2.78 \times 10^{-4}$ | 33 | 1662 | 18 | × |
| 42 | | 100 | 30 | 2 | $2.78 \times 10^{-4}$ | 67 | 1662 | 18 | Δ |
| 43 | | 100 | 30 | 4 | $2.78 \times 10^{-4}$ | 133 | 1662 | 18 | ◎ |
| 44 | | 100 | 30 | 10 | $2.78 \times 10^{-4}$ | 333 | 1662 | 18 | ◎ |
| 45 | 0.3 | 100 | 50 | 1 | $1.67 \times 10^{-4}$ | 20 | 2770 | 21 | × |
| 46 | | 100 | 50 | 2 | $1.67 \times 10^{-4}$ | 40 | 2770 | 21 | × |
| 47 | | 100 | 50 | 4 | $1.67 \times 10^{-4}$ | 80 | 2770 | 21 | Δ |
| 48 | | 100 | 50 | 10 | $1.67 \times 10^{-4}$ | 200 | 2770 | 21 | ◎ |

(Notes)
×: Minute streaks occurred, and surface was found rough by naked eye.
Δ: Small number of minute streaks occurred, but electromagnetic conversion property was acceptable.
○: Minute streaks did not occur, and electromagnetic conversion property had no problem.
◎: Minute streaks did not occur, and electromagnetic conversion property was good.

Actual Example 3 of the Invention

Figure 5:
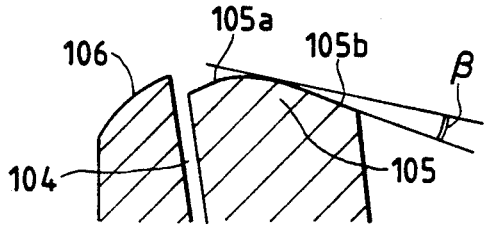
FIG. 5 is a sectional view of the major part of the device.

The magnetic liquid D3 of 60 $m^2/g$ in $S_{BET}$ value was applied under the same conditions as the actual example 2. The surfaces of magnetic layers formed of the applied liquids on carriers were observed, and the electromagnetic conversion properties of the layers were examined. FIG. 5 shows the results of the observation and the examination.

TABLE 5

| No. | Slot width (mm) | Application speed u (m/min) | Film thickness h (μ) | Liquid length L (mm) | Shearing speed $\dot{\gamma}$ ($sec^{-1}$) | Flow index A | Shearing speed in slot ($sec^{-1}$) | (Applied liquid D3) Viscosity (cp) | Surface state |
|---|---|---|---|---|---|---|---|---|---|
| 49 | 0.6 | 50 | 10 | 1 | $4.17 \times 10^{-4}$ | 100 | 70 | 21 | Δ |
| 50 | | 50 | 10 | 2 | $4.17 \times 10^{-4}$ | 100 | 70 | 21 | ○ |
| 51 | | 50 | 10 | 4 | $4.17 \times 10^{-4}$ | 400 | 70 | 21 | ◎ |
| 52 | | 50 | 10 | 10 | $4.17 \times 10^{-4}$ | 1000 | 70 | 21 | ◎ |
| 53 | 0.6 | 50 | 30 | 1 | $1.39 \times 10^{-4}$ | 33 | 210 | 27 | × |
| 54 | | 50 | 30 | 2 | $1.39 \times 10^{-4}$ | 67 | 210 | 27 | × |
| 55 | | 50 | 30 | 4 | $1.39 \times 10^{-4}$ | 133 | 210 | 27 | Δ |
| 56 | | 50 | 30 | 10 | $1.39 \times 10^{-4}$ | 333 | 210 | 27 | ○ |
| 57 | 0.6 | 50 | 50 | 1 | $8.33 \times 10^{-3}$ | 20 | 350 | 32 | × |
| 58 | | 50 | 50 | 2 | $8.33 \times 10^{-3}$ | 40 | 350 | 32 | × |

TABLE 5-continued

| No. | Slot width (mm) | Application speed u (m/min) | Film thickness h (μ) | Liquid length L (mm) | Shearing speed $\dot{\gamma}$ ($sec^{-1}$) | Flow index A | Shearing speed in slot ($sec^{-1}$) | (Applied liquid D3) Viscosity (cp) | Surface state |
|---|---|---|---|---|---|---|---|---|---|
| 59 | | 50 | 50 | 4 | $8.33 \times 10^{-3}$ | 80 | 350 | 32 | × |
| 60 | | 50 | 50 | 10 | $8.33 \times 10^{-3}$ | 200 | 350 | 32 | ○ |
| 61 | | 100 | 10 | 1 | $8.33 \times 10^{-4}$ | 100 | 140 | 18 | ○ |
| 62 | 0.6 | 100 | 10 | 2 | $8.33 \times 10^{-4}$ | 200 | 140 | 18 | ⊙ |
| 63 | | 100 | 10 | 4 | $8.33 \times 10^{-4}$ | 400 | 140 | 18 | ⊙ |
| 64 | | 100 | 10 | 10 | $8.33 \times 10^{-4}$ | 1000 | 140 | 18 | ⊙ |
| 65 | 0.6 | 100 | 30 | 1 | $2.78 \times 10^{-4}$ | 33 | 420 | 23 | × |
| 66 | | 100 | 30 | 2 | $2.78 \times 10^{-4}$ | 67 | 420 | 23 | × |
| 67 | | 100 | 30 | 4 | $2.78 \times 10^{-4}$ | 133 | 420 | 23 | ○ |
| 68 | | 100 | 30 | 10 | $2.78 \times 10^{-4}$ | 333 | 420 | 23 | ⊙ |
| 69 | 0.6 | 100 | 50 | 1 | $1.67 \times 10^{-4}$ | 20 | 700 | 25 | × |
| 70 | | 100 | 50 | 2 | $1.67 \times 10^{-4}$ | 40 | 700 | 25 | × |
| 71 | | 100 | 50 | 4 | $1.67 \times 10^{-4}$ | 80 | 700 | 25 | × |
| 72 | | 100 | 50 | 10 | $1.67 \times 10^{-4}$ | 200 | 700 | 25 | ○ |
| 73 | 0.6 | 200 | 10 | 1 | $1.67 \times 10^{-5}$ | 100 | 280 | 17 | ⊙ |
| 74 | | 200 | 10 | 2 | $1.67 \times 10^{-5}$ | 200 | 280 | 17 | ⊙ |
| 75 | | 200 | 10 | 4 | $1.67 \times 10^{-5}$ | 400 | 280 | 17 | ⊙ |
| 76 | | 200 | 10 | 10 | $1.67 \times 10^{-5}$ | 1000 | 280 | 17 | ⊙ |
| 77 | 0.6 | 200 | 30 | 1 | $5.56 \times 10^{-4}$ | 33 | 840 | 20 | × |
| 78 | | 200 | 30 | 2 | $5.56 \times 10^{-4}$ | 67 | 840 | 20 | × |
| 79 | | 200 | 30 | 4 | $5.56 \times 10^{-4}$ | 133 | 840 | 20 | Δ |
| 80 | | 200 | 30 | 10 | $5.56 \times 10^{-4}$ | 333 | 840 | 20 | ⊙ |
| 81 | 0.6 | 200 | 50 | 1 | $3.33 \times 10^{-4}$ | 20 | 1400 | 22 | × |
| 82 | | 200 | 50 | 2 | $3.33 \times 10^{-4}$ | 40 | 1400 | 22 | × |
| 83 | | 200 | 50 | 4 | $3.33 \times 10^{-4}$ | 80 | 1400 | 22 | Δ |
| 84 | | 200 | 50 | 10 | $3.33 \times 10^{-4}$ | 200 | 1400 | 22 | ○ |
| 85 | 0.3 | 100 | 10 | 1 | $8.33 \times 10^{-4}$ | 100 | 554 | 18 | ○ |
| 86 | | 100 | 10 | 2 | $8.33 \times 10^{-4}$ | 200 | 554 | 18 | ⊙ |
| 87 | | 100 | 10 | 4 | $8.33 \times 10^{-4}$ | 400 | 554 | 18 | ⊙ |
| 88 | | 100 | 10 | 10 | $8.33 \times 10^{-4}$ | 1000 | 554 | 18 | ⊙ |
| 89 | 0.3 | 100 | 30 | 1 | $2.78 \times 10^{-4}$ | 33 | 1662 | 23 | × |
| 90 | | 100 | 30 | 2 | $2.78 \times 10^{-4}$ | 67 | 1662 | 23 | Δ |
| 91 | | 100 | 30 | 4 | $2.78 \times 10^{-4}$ | 133 | 1662 | 23 | ⊙ |
| 92 | | 100 | 30 | 10 | $2.78 \times 10^{-4}$ | 333 | 1662 | 23 | ⊙ |
| 93 | 0.3 | 100 | 50 | 1 | $1.67 \times 10^{-4}$ | 10 | 2770 | 25 | × |
| 94 | | 100 | 50 | 2 | $1.67 \times 10^{-4}$ | 40 | 12770 | 25 | × |
| 95 | | 100 | 50 | 4 | $1.67 \times 10^{-4}$ | 80 | 2770 | 25 | Δ |

(Note)
×: Minute streaks occurred, and surface was found rough by naked eye.
Δ: Small number of minute streaks occurred, but electromagnetic conversion property was acceptable.
○: Minute streaks did not occur, and electromagnetic conversion property had no problem.
⊙: Minute streaks did not occur, and electromagnetic conversion property was good.

It is understood from Tables 4 and 5 that the magnetic layers did not undergo minute streaking and had a good electromagnetic conversion property with regard to the high-viscosity liquids in which the $S_{BET}$ value of the magnetic alloy was 45 $m^2/g$ or more, the added quantity of the main binders per weight to the alloy was 2.3 $mg/m^2$ or more, and the flow index A was 100 or more. Moreover, when the shearing speed of the liquid in the slot was 1,000 $sec^{-1}$ or more, a nearly acceptable magnetic layer was formed, even if the flow index A of the liquid was 80 or more.

Another preferred embodiment of the present invention now will be described in detail with reference to the accompanying drawings.

Figure 3:
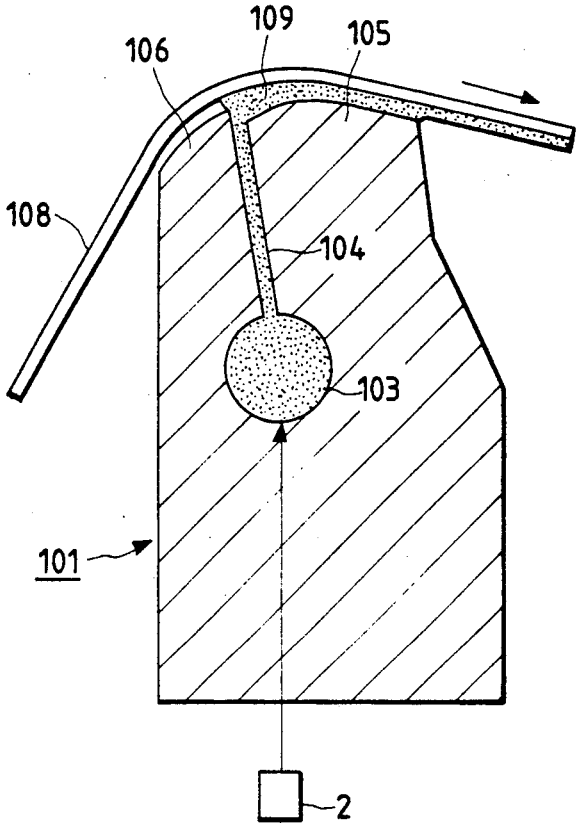
FIGS. 3 and 4 are sectional views of a major part of an extrusion-type applicator in accordance with one embodiment of the present invention, FIG. 3 being a sectional view of the part of the device in the state of actual application, and FIG. 4 indicating the details of the form of the top part of the application head of the device.
Figure 4:
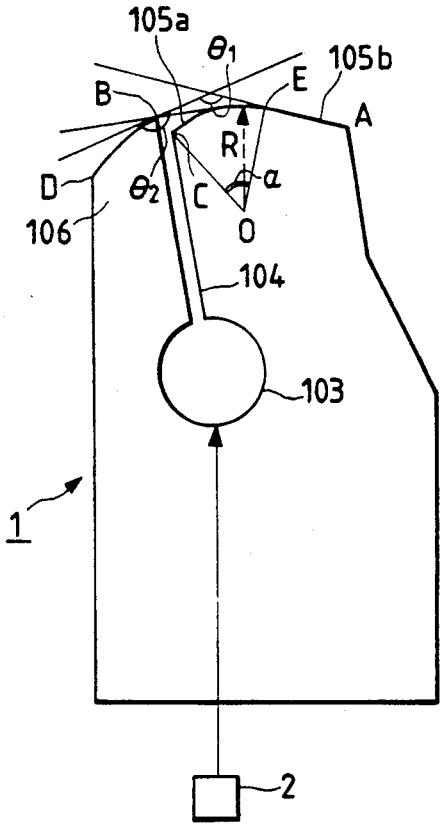

In FIGS. 3 and 4, an application head 101 includes a pocket 103, a slot 104, a doctor edge portion 105, and a back edge portion 106, and applies a magnetic liquid 109 at a uniform thickness to a web 108 moving at a fixed speed. The device has a liquid supply line 102 including a fixed quantity liquid supply pump provided outside the body of the application head 101 so as to supply the magnetic liquid 109 continuously at a fixed flow rate to the head, and a piping portion through which the pump is connected to the pocket 103 extending in the body of the head along the width of the web 108. The slot 104 extends in the body of the head 101 from the pocket 103 toward the web 108, and is open with a width at the top of the head. The slot 104 is a relatively narrow passage extending along the width of the web as well as the pocket 103. The length of the opening of the slot 104 along the width of the web 108 is nearly equal to the width of the application area of the web 108.

The back edge portion 106, located at the trailing side of the outlet portion of the slot 104 with respect to the direction of the movement of the web 108, has a surface facing the web. The doctor edge portion 105, located at the leading side of the outlet portion of the slot 104 with respect to the direction of the movement of the web 108, has upstream and downstream surfaces **105*a* and 105*b* facing the web. The curved upstream surface 105*a* extends to the downstream edge of the outlet portion of the slot 104. The flat downstream surface 105*b* extends downstream from the upstream surface 105*a*, and is coincident with the tangent on the upstream surface at the downstream edge thereof. The edge B of the upper surface of the back edge portion 106 at the upstream edge of the outlet portion of the slot 104 is located so that the angle $\theta_1$ between the tangent on the curved surface of the doctor edge portion 105 at the downstream edge E of the surface and the tangent on the upper curved surface of the back edge portion at the edge B, and the angle $\theta_2$ between the tangent on the curved surface of the back edge portion at the edge B and the tangent on the curved surface of the doctor edge portion and on the edge B are conditioned as $\theta_1 < \theta_2 < 180°$ with regard to the cross sections of the back edge portion and the doctor edge portion. Since the angles $\theta_1$ and $\theta_2$ are less than 180° and $\theta_1 < \theta_2$, the upper curved surface 105***a* of the doctor edge portion 105 is located farther from the web 108 than that of the back edge portion 106. As a result, the pressure which is applied to the liquid 109 by the curved surface of the doctor edge portion is satisfactory. The radius of curvature R of the curved surface 105*a* of the doctor edge portion 105 is less than or equal to 8.0 mm. The angle ∠COE between the radius from the center 0 of the curvature of the curved surface 105*a* of the doctor edge portion 105 to the upstream edge C of the curved surface at the downstream edge of the outlet portion of the slot 104 and the radius from the center 0 to the downstream edge E of the curved surface is less than or equal to 30°.

With the radius of curvature R and the angle ∠COE set as mentioned above, the length of the upstream curved surface 105*a* along the direction of the movement of the web 108 will be within a prescribed range. Further, the total length of the upstream and downstream surfaces 105*a* and 105*b* of the doctor edge portion 105 from the upstream edge C of the upstream surface to the downstream edge A of the downstream surface will be at least 2 mm. As a result, when the liquid 109 is applied to the web 108 by the head 101, appropriate pressure acts on the liquid in the gap between the surface of the web 108 and the surface of the doctor edge portion.

An appropriate shearing force acts on the liquid for a relatively long time so that the flowing property of the liquid is kept appropriate to provide a very good surface of film of the applied liquid. Thus, very high pressure can be applied to the liquid 109 by the upstream curved surface 105*a* of the doctor edge portion 105 to prevent air from being entrained in the liquid. Even if the liquid 109 is a magnetic liquid high in $S_{BET}$ and viscosity and having a re-cohering property or the like, for example, the flowing property of the liquid is kept appropriate by the downstream surface 105*b* of the doctor edge portion 105 for a relatively long time immediately after the high pressure is applied to the liquid by the upstream curved surface 105*a* of the portion, so that the liquid is smoothed well. This is presumed to produce a very favorable effect which cannot be produced by conventional devices and techniques. Since the downstream surface 105*b* of the doctor edge portion 105 is flat, the processing property of the surface is sufficiently high to make it easy to enhance the accuracy of the processing of the surface to improve the state of the surface of the film of the applied liquid 109 on the web 108.

The web 108 s a flexible carrier made of a high-molecular film such as a polyethylene terephthalate film, paper, a metal sheet or the like.

Figure 6:
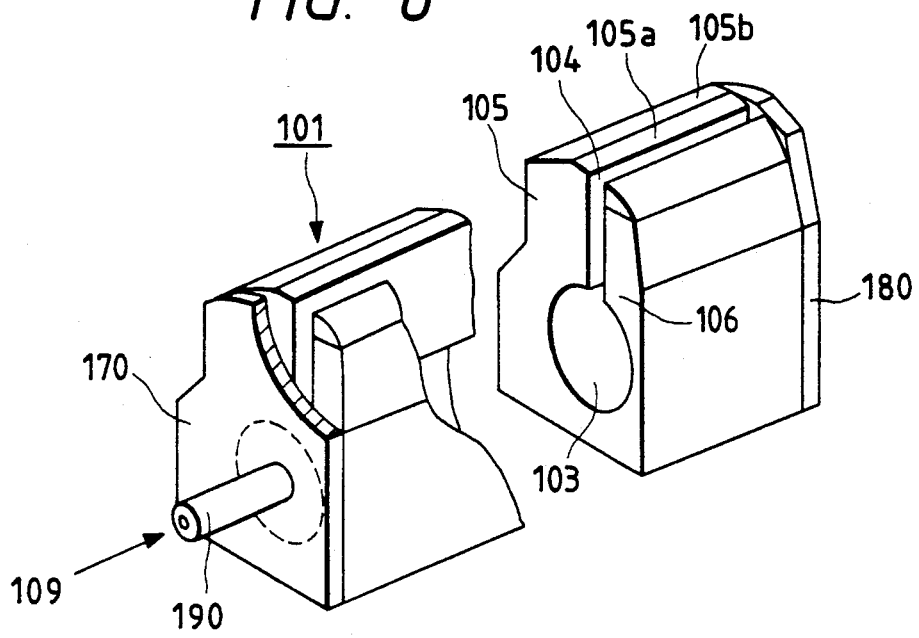
FIGS. 6, 7 and 8 are perspective views showing different liquid supply lines for the device.
Figure 7:
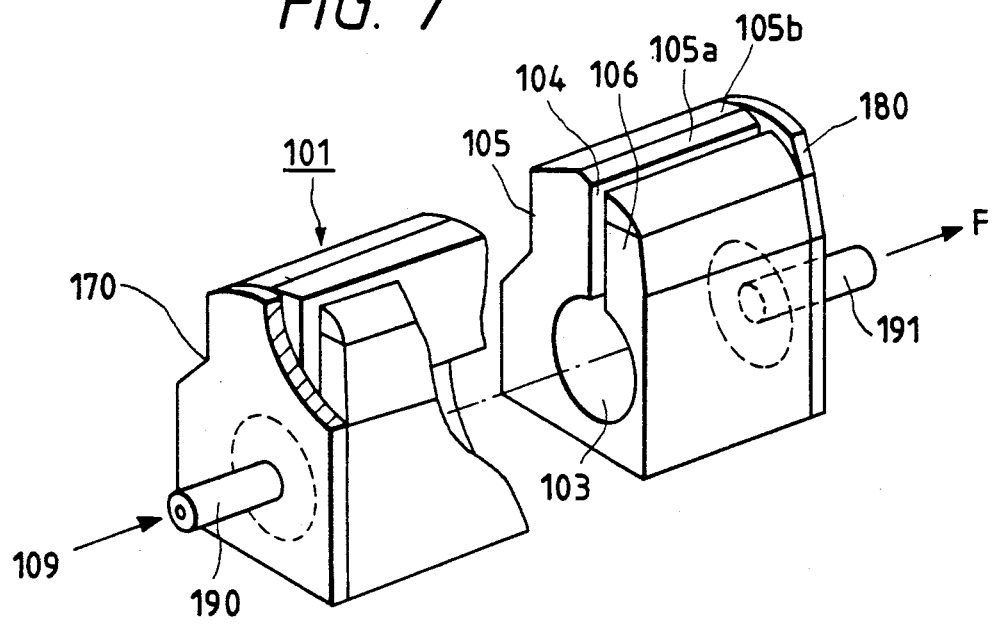
Figure 8:
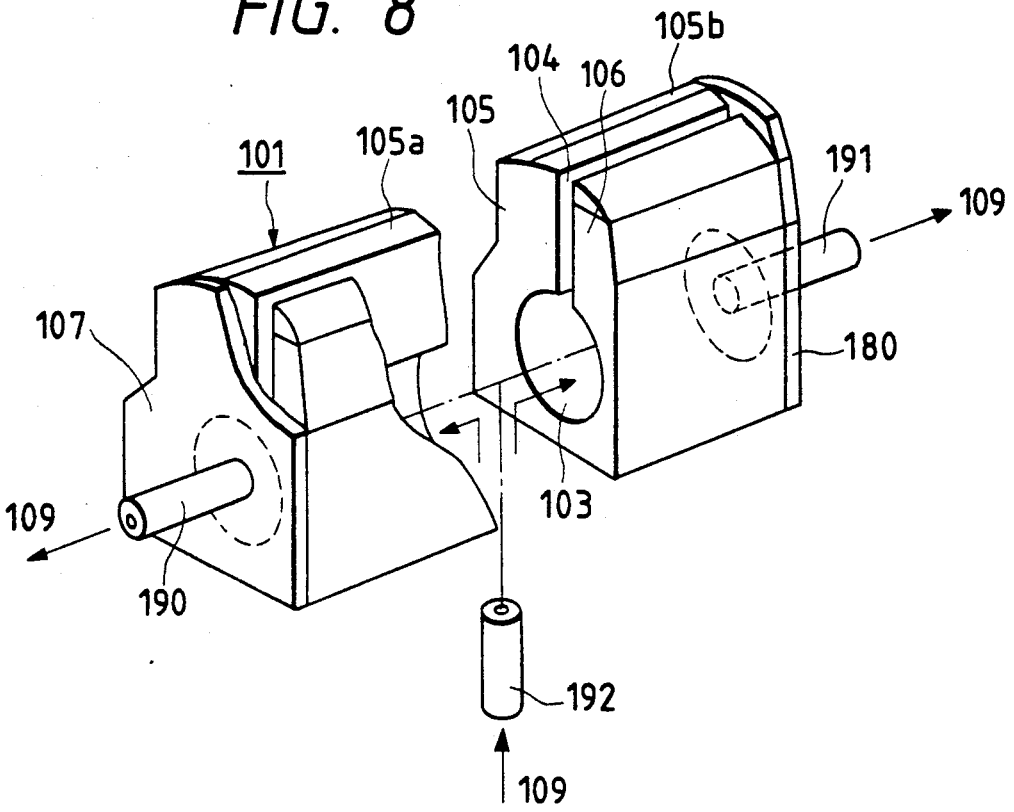

The liquid supply line 102 has a single pipe 190 connected to one of both the end plates 170 and 180 of the application head 101 to supply the liquid 109 thereto, as shown in FIG. 6, a single pipe 190 for supplying the liquid to the head and another single pipe 190 for pushing out or pulling out an appropriate quantity of the supplied liquid, as shown in FIG. 7, or a single pipe 192 for supplying the liquid to the bottom of the nearly central portion of the pocket 103 and single pipes 190 and 191 for pushing out or pulling out an appropriate quantity of the supplied liquid from both the ends of the pocket, as shown in FIG. 8.

The angle $\beta$ between the flat downstream surface 105*b* of the doctor edge portion 105 and the tangent on the curved upstream surface 105*a* thereof at the downstream edge E of the upstream surface, which is shown in FIG. 5, is set to be $0° \leqq \beta \leqq 5°$, so that the liquid pressure, which is heightened on the upstream curved surface, is lowered gradually and smoothly to avoid deteriorating the state of the surface of the film of the applied liquid 109 on the web 108.

Although the upper surface of the back edge portion 106 is curved appropriately in the embodiment described above, the surface may be flat. If the upper surface is flat, the tangent on the surface should be the production from the surface.

Although the applicator device is for applying liquid to the web to provide a single layer thereon, the present invention is not confined thereto, but rather may be embodied as an applicator device for applying a plurality of liquids to a web to provide a plurality of layers thereon. Since the doctor edge portion of the latter device e, which participates in the application of the liquid for making the uppermost layer, greatly affects the state of the surface of the film of all the liquids, at least the doctor edge portion should be constituted in accordance with the present invention.

In an applicator device provided in accordance with the present invention, the doctor edge portion of an applicator head includes a curved surface extending to the downstream edge of the outlet portion o a slot, and a flat surface extending downstream from the curved surface along the tangent on the curved surface at the downstream edge thereof. As a result, when a liquid is applied to a web by the head, appropriate pressure acts on the liquid in the gap between the doctor edge portion and the surface of the web, and an appropriate shearing force acts on the liquid for a relatively long time. Thus, very high pressure is applied to the liquid by the curved surface of the doctor exit portion to proven air from being involved into the liquid, enhancing the rapid application performance of the device. Even if the liquid is a high-viscosity magnetic liquid, the flowing property of the liquid is kept appropriate by the flat downstream surface of the doctor edge portion for a relatively long time immediately after high pressure is applied o the liquid by the curved upstream surface o the portion, so that the liquid is smoothed to make the sate of the surface of the films the applied liquid on the web very good. For that reason, even fi the liquid is a magnetic liquid including a magnetic substance whose $S_{BET}$ value is high to make the viscosity of the liquid high, the liquid can be applied rapidly to the web by the device to make a thin film on the web, thus enabling manufacture of a magnetic recording medium whose electromagnetic converting property is satisfactory.

The novel effects of the present invention will be clarified hereafter by describing further actual examples of thereof.

Actual Example 4 of the Invention

Substances shown in Table 6 were put in a ball mill and mixed and dispersed together for 10 ½ hours to produce liquids A and B. Table 7 shows the magnetic alloys of the liquids A and B, the $S_{BET}$ values o the alloys, and the quantities o a copolymer of vinyl chloride and vinyl acetate and urethane which are the main binders of the liquids.

TABLE 6

| | |
|---|---|
| Magnetic alloy (magnetic metal powder of iron powder) | 100 parts by weight |
| Copolymer of vinyl chloride and vinyl acetate (containing sodium sulfonate and epoxy group) | X parts by weight |
| Urethane (polyurethane containing sulfonic group) | Y parts by weight |
| Hardener (Coronate L) | 5 parts by weight |
| Stearic acid | 0.5 part by weight |
| Oleic acid | 0.5 part by weight |
| Butyl stearate | 1 part by weight |
| Carbon black (80μ in mean grain diameter) | 1 part by weight |
| Abrasive ($\alpha$-$Al_2O_3$) | 10 parts by weight |
| Methyl ethyl ketone | 180 parts by weight |
| Cyclohexane | 120 parts by weight |

TABLE 7

| Applied liquid | $S_{BET}$ value ($m^2/g$) | X parts by weight of copolymer | Y parts by weight of urethane | Magnetic alloy |
|---|---|---|---|---|
| A | 30 | 5.0 | 2.5 | $\gamma$-$Fe_2O_3$ powder |
| B | 45 | 7.5 | 3.75 | Magnetic metal powder |

Each of the liquids A and B was applied to a polyethylene terephthalate carrier 20 μ thick and 300 mm wide to make a single thin film thereon. The application speed was set at 200 m/min, 300 m/min and 400 m/min. The tension of the liquid application part of the carrier was 4 kg for a 300 mm wide carrier. The thickness of the wet film of the applied liquid on the carrier was set at 5 μ, 10 μ and 15 μ. Accordingly, Specimens Nos. 1, 2 and 3 were produced from the liquids A and B. Specimens No. 1 were produced by using the application head which is shown in FIG. 3 and in which the radius of the curvature of the curved upstream surface 105*a* of the doctor edge portion 105 and the total length of the upstream and downstream surfaces 105*a* and 105*b* of the portion along the direction of the movement of the carrier were 1.0 mm and 5.0 mm, respectively. Specimens No. 2 were produced by using an application head which was disclosed in Japanese Patent OPI No. 104666/85 and in which the angle between the surfaces of the doctor edge portion of the head inside the surfaces and the total length of the surfaces along the direction of the movement of the carrier were 165 degrees and 5 mm, respectively. Specimens No. 3 were produced by using an application head which was disclosed in Japanese Patent OPI No. 84711/89 and in which the radius of the curvature of the surface of the doctor edge portion of the head was 1.0 mm.

The surfaces of magnetic layers made from the liquids A and B on the carriers were observed, and the electromagnetic converting property of each of the layers was examined. Tables 8 and 9 show the results of the observation and the examination. Table 8 also shows the results of observing whether the surfaces of the layers were affected by involved air or not. X, Δ and ○ in Table 8 denote the results as follows:

X: Uniformity of the surface of the layer was deteriorated by entrained air, and the surface was found to be rough even with naked eye.

Δ: Some surfaces were good, but reproducibility was low.

○: Surface was not affected by involved air, and therefore was good.

TABLE 8

| Applied liquid | Application speed (m/min) | Specimen No. 1 Film thickness (μ) 5 | 10 | 15 | Specimen No. 2 Film thickness (μ) 5 | 10 | 15 | Specimen No. 3 Film thickness (μ) 5 | 10 | 15 |
|---|---|---|---|---|---|---|---|---|---|---|
| A | 200 | ○ | ○ | ○ | Δ | Δ | ○ | ○ | ○ | ○ |
| | 300 | ○ | ○ | ○ | X | X | Δ | ○ | ○ | ○ |
| | 400 | ○ | ○ | ○ | X | X | X | ○ | ○ | ○ |
| B | 200 | ○ | ○ | ○ | X | Δ | ○ | ○ | ○ | ○ |
| | 300 | ○ | ○ | ○ | X | X | Δ | ○ | ○ | ○ |
| | 400 | ○ | ○ | ○ | X | X | X | ○ | ○ | ○ |

Table 9 chiefly shows the results of observing whether the microscopic states of the surfaces of the layers were good. The signs X, Δ and ○ in Table 9 denote the results as follows:

X: Minute streaks occurred, and the surface was found to be rough, even with the naked eye.

Δ: A small number of minute streaks occurred, but there was no problem in electromagnetic converting property.

○: No minute streaks occurred, and the electromagnetic converting property was good.

TABLE 9

| Applied liquid | Application speed (m/min) | Specimen No. 1 Film thickness (μ) 5 | 10 | 15 | Specimen No. 2 Film thickness (μ) 5 | 10 | 15 | Specimen No. 3 Film thickness (μ) 5 | 10 | 15 |
|---|---|---|---|---|---|---|---|---|---|---|
| A | 200 | ○ | ○ | ○ | Δ | ○ | ○ | ○ | Δ | Δ |
| | 300 | ○ | ○ | ○ | X | X | Δ | ○ | ○ | Δ |
| | 400 | ○ | ○ | ○ | X | X | X | ○ | ○ | Δ |
| B | 200 | ○ | ○ | ○ | X | ○ | ○ | X | X | X |
| | 300 | ○ | ○ | ○ | X | X | Δ | Δ | X | X |
| | 400 | ○ | ○ | ○ | X | X | X | Δ | Δ | X |

It is understood from Tables 8 and 9 that conspicuously better results were achieved by the application head according to the present invention, than by the conventional application heads, particularly when the $S_{BET}$ value of the magnetic alloy of the liquid was as high as 45 $m^2/g$ to make the viscosity of the liquid high and when the speed of the application was high.

Actual Example 5 of the Invention

The liquid B was applied to the web by using the applicator head which is shown in FIG. 3 and whose dimensions were the same as in actual example 4, except that the total lengths of the surfaces of the doctor edge portion of the head were altered to be 1 mm, 2 mm, 4 mm, 6 mm and 10 mm. The surfaces of magnetic layers made from the liquid B on the webs were observed. The application speed was 300 m/min. The thickness of the layer was set at 5 μ, 10 μ, and 15 μ. The other conditions were the same as in actual example 4. Table 10 shows the results of the observation. X, Δ and ○ in Table 10 denote the results as follows:

X: Minute streaks occurred, and the surface was found to be rough, even with the naked eye.

Δ: A small number of minute streaks occurred, but there was no problem in electromagnetic converting property.

○: No minute streaks occurred, and the electromagnetic converting property was good.

TABLE 10

| | Length of edge surfaces | 1 mm | 2 mm | 4 mm | 6 mm | 10 mm |
|---|---|---|---|---|---|---|
| Film thick-ness | 5μ | X | ○ | ○ | ○ | ○ |
| | 10μ | X | Δ | ○ | ○ | ○ |
| | 15μ | X | Δ | Δ | ○ | ○ |

It is understood from Table 10 that the total length of the surfaces of the doctor edge portion should be at least 2 mm.

Actual Example 6 of the Invention

The liquid B was applied to the web by using the applicator head which is shown in FIG. 3 and whose dimensions were the same as the actual example 4 except that the radius R of the curvature of the curved surface 105*a* of the doctor edge portion was set to be 4 mm, 6 mm, 8 mm 10 mm and 12 mm. The surfaces of magnetic layers made from the applied liquid on the webs were observed. The application speed was 300 m/min. The thickness of the layers was set at 5 μ, 10 μ, and 15 μ. The other conditions were the same as the actual example 4. Table 11 shows the results of the observation. X, Δ and ○ in Table 11 denote the results as follows:

X: Minute streaks occurred, and the surface was found to be rough, even with the naked eye.

Δ: A small number of minute streaks occurred, but there was no problem in electromagnetic converting property.

○: No minute streaks occurred, and the electromagnetic converting property was good.

TABLE 11

| | Radius of curvature | 4 mm | 6 mm | 8 mm | 10 mm | 12 mm |
|---|---|---|---|---|---|---|
| Film thick-ness | 5μ | ○ | ○ | Δ | X | X |
| | 10μ | ○ | ○ | 1090Y | X | X |
| | 15μ | ○ | ○ | — | Δ | X |

It is understood from Table 11 that there is a boundary point near 8 mm for the radius of the curvature o the curved surface of the doctor edge portion. The pressure of the liquid is heightened effectively below the boundary point to yield good results.

Actual Example 7 of the Invention

The liquid B was applied to the web by using the applicator head which is shown in FIG. 3 and whose dimensions were the same as the actual example 4, except that the angle βbetween the tangent on the curved surface 105*a* o the doctor edge portion and the flat surface 105*b* of the portion was set to be 1°, 3°, 5°, and 7°. the application speed was 300 m/min. The thickness of magnetic layers made from the applied liquid on the webs as set at 5 μ, 10 μ, and 15 μ. The entire length of the application to each of the web as was 4,000 m. the other conditions wee the same as the actual example 4. Table 12 shows the results of the microscopic observation of the surfaces of the layers. During the observation, the number of streaks over the entire width of the layer was checked.

TABLE 12

| | Angle β | 1° | 3° | 5° | 7° |
|---|---|---|---|---|---|
| Film thickness | 5μ | 0 | 0 | 1 | 6 |
| | 10μ | 0 | 0 | 0 | 3 |

TABLE 12-continued

| | Angle β | 1° | 3° | 5° | 7° |
|---|---|---|---|---|---|
| | 15μ | 0 | 0 | 0 | 1 |

It is understood from Table 12 that it is preferable that the angle β be not more than 5° and not less than 0°.

Actual Example 8 of the Invention

The liquid B was applied to the web by using the applicator head which is shown in FIG. 3 and whose dimensions were the same as the actual example 4 except that the angle ∠COE prescribing the length of the curved surface 105*a* of the doctor edge portion along the direction of the movement of the web was set at various values and the radius R of the curvature of the curved surface was set at 8 mm. The application speed was 300 m/min. The thickness of magnetic layers made from the applied liquid on the webs was set at 5 μ, 10 μ and 15 μ. The entire length of the application to each of the webs was 4,000 m. The other conditions were the same as the actual example 4. It was examined through a microscope how many streaks there were on each of the layers over the entire width thereof and whether the layer was affected by entrained air. Table 13 shows the results of the examination. X, Δ and ○ denote the results as follows:

X: Minute streaks occurred, and the surface was found to be rough, even with the naked eye.

Δ: A small number of minute streaks occurred, but there was no problem in electromagnetic converting property.

○: No minute streaks occurred, and the electromagnetic converting property was good.

TABLE 13

| | Angle ∠COE | 5° | 20° | 30° | 35° |
|---|---|---|---|---|---|
| Film thickness | 5μ | ○ | ○ | Δ | X |
| | 10μ | ○ | ○ | ○ | Δ |
| | 15μ | ○ | ○ | ○ | Δ |

It is understood from Table 13 that the application was good when the angle ∠COE prescribing the length of the curved surface of the doctor edge portion along the direction of the movement of the web was 30° or less.

Actual Example 9 of the Invention

The liquid A including the iron oxide and the liquid B including the metal were applied simultaneously to the web so that lower and an upper layers were made thereon from the liquids A and B, respectively.

Figure 9:
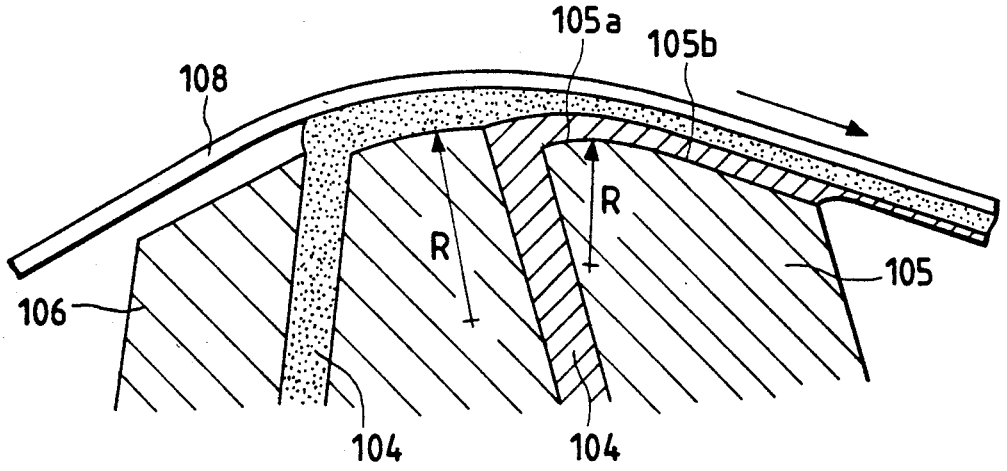
FIG. 9 is a sectional view of a major part of a multiple-application head provided in accordance with the present invention.

An applicator head which was basically was similar to that disclosed in the Japanese Patent Application (OPI) No. 84711/89 and had first and second doctor edge portions as shown in FIG. 9 was used for the application to produce specimens No. 4. The second doctor edge portion was constituted in accordance with the present invention. The radius of curvature R of the surface of the first doctor edge portion and the length of the surface along the direction of the movement of the web were 1.0 mm and 0.3 mm, respectively. The radius of curvature R of the upstream surface of the second doctor edge portion and the total length of the surfaces the portion were 5.0 mm and 4.0 mm, respectively.

The application head disclosed in Japanese Patent OPI No. 84711/89 was used for the application to produce specimens No. 5. The radius R of the curvature of the surface of the first doctor edge portion of the head and the length of the surface along the direction of the movement of the web were 1.0 mm and 0.3 mm, respectively. The radius of curvature R of the surface of the second doctor edge portion of the head and the length of the surface along the direction of the movement of the web were 5.0 mm and 1.5 mm, respectively.

The thickness of the lower layer in the liquid state and that of the upper layer in the liquid state were set at 15 μ and at 2 μ, 4 μ and 6 μ, respectively. Table 14 denotes the results as follows;

X: Minute streaks occurred, and the surface was found to be rough, even with the naked eye.

Δ: A small number of minute streaks occurred, but there was no problem in electromagnetic converting property.

○: No minute streaks occurred, and the electromagnetic converting property was good.

TABLE 14

| Application speed (m/min) | Specimen No. 4 Film thickness (μ) 2 | 4 | 6 | Specimen No. 5 Film thickness (μ) 2 | 4 | 6 |
|---|---|---|---|---|---|---|
| 200 | ○ | ○ | ○ | X | X | X |
| 300 | ○ | ○ | ○ | Δ | X | X |
| 400 | ○ | ○ | ○ | Δ | Δ | X |

It is understood from Table 14 that the results of application using an applicator head whose second doctor edge portion was constituted in accordance with the present invention were good.

Also, it is clear through the examination of the actual examples 4–9 of the present invention that, even if the viscosity of the liquid is high, it can be applied rapidly to the web with the inventive applicator head, to provide a for the magnetic layer.

While the present invention has been described in detail with reference to a preferred embodiment, various changes within the spirit of the invention will be apparent to those of working skill in this technological field. Consequently, the invention should be considered as limited only by the scope of the appended claims.

What is claimed is:

1. In a method for manufacturing a magnetic recording medium in which a coating liquid is continuously extruded from the outlet of a slot of an application device onto the surface of a flexible carrier continuously moving along the surface of a back edge portion and a doctor edge portion of said application device, the improvement wherein a liquid in which a magnetic substance whose $S_{bet}$ value is 45 $m_2/g$ or more is included in said coating liquid, an added quantity of a main binder expressed in weight per unit surface area of magnetic particles in said coating liquid for said value in said coating liquid is 2.4 $mg/m^2$ or more, and a flow index A expressed by an equation (1) below and in which L, V and $\dot{\gamma}$ denote the length of said liquid on the surface of said doctor edge portion in the direction of movement of said carrier along the surface of said doctor edge portion, the mean speed of the flow of said liquid on the surface of said doctor edge portion, and the shearing speed of said liquid on the surface of said doctor edge portion, respectively, is 100 or more:

$$A = \dot{\gamma}\frac{L}{V}. \quad (1)$$

2. In a method for manufacturing a magnetic recording medium in which a coating liquid is continuously extruded from the outlet of a slot of an application device onto the surface of a flexible carrier continuously moving along the surface of a back edge portion and a doctor edge portion of said application device, the improvement wherein a liquid in which a magnetic substance whose $S_{BET}$ value is 45 $m^2/g$ or more is included in said coating liquid, an added quantity of a main binder per unit weight for said value in said coating liquid is 2.4 $mg/m^2$ or more, said coating liquid has a shearing speed of 1,000 $sec^{-1}$ or more in said slot, and a flow index A expressed by an equation (1) below and in which L, V and $\dot{\gamma}$ denote the length of said liquid on the surface of said doctor edge portion in the direction of movement of said carrier along the surface of said doctor edge portion, the means speed of the flow of said liquid on the surface of said doctor edge portion, and he shearing speed of said liquid on the surface of said doctor edge portion, respectively, is 80 or more:

$$A = \dot{\gamma}\frac{L}{V}. \quad (1)$$

* * * * *